US008825494B2

(12) United States Patent
Mogi et al.

(10) Patent No.: US 8,825,494 B2
(45) Date of Patent: Sep. 2, 2014

(54) COMPUTATION APPARATUS AND METHOD, QUANTIZATION APPARATUS AND METHOD, AUDIO ENCODING APPARATUS AND METHOD, AND PROGRAM

(75) Inventors: Yukihiko Mogi, Kanagawa (JP); Masato Kamata, Tokyo (JP)

(73) Assignee: Sony Corporation, Tokyo (JP)

( * ) Notice: Subject to any disclaimer, the term of this patent is extended or adjusted under 35 U.S.C. 154(b) by 950 days.

(21) Appl. No.: 12/553,517

(22) Filed: Sep. 3, 2009

(65) Prior Publication Data

US 2010/0063826 A1 Mar. 11, 2010

(30) Foreign Application Priority Data

Sep. 5, 2008 (JP) ..... 2008-228163

(51) Int. Cl.
*G10L 19/00* (2013.01)

(52) U.S. Cl.
USPC ..... 704/500; 704/501; 704/503; 704/504

(58) Field of Classification Search
USPC ..... 704/500, 501, 503, 504
See application file for complete search history.

(56) References Cited

U.S. PATENT DOCUMENTS

| | | | | |
|---|---|---|---|---|
| 5,327,520 | A * | 7/1994 | Chen | 704/219 |
| 5,946,652 | A * | 8/1999 | Heddle | 704/230 |
| 6,246,979 | B1 * | 6/2001 | Carl | 704/219 |
| 6,597,815 | B1 | 7/2003 | Satoh et al. | |
| 6,971,013 | B2 | 11/2005 | Mihcak et al. | |
| 2001/0050959 | A1 | 12/2001 | Nishio et al. | |
| 2003/0118243 | A1 | 6/2003 | Sezer et al. | |
| 2005/0063471 | A1 * | 3/2005 | Regunathan et al. | 375/240.21 |
| 2005/0069214 | A1 | 3/2005 | Hayashi et al. | |
| 2005/0097312 | A1 | 5/2005 | Mihcak et al. | |
| 2007/0094018 | A1 | 4/2007 | Zinser et al. | |
| 2008/0065709 | A1 | 3/2008 | Hack | |
| 2010/0082589 | A1 * | 4/2010 | Mogi et al. | 707/706 |
| 2010/0082717 | A1 | 4/2010 | Mogi et al. | |

FOREIGN PATENT DOCUMENTS

| | | | |
|---|---|---|---|
| JP | 06-083400 | A | 3/1994 |
| JP | 06-318154 | A | 11/1994 |
| JP | 10-243028 | A | 9/1998 |
| JP | 11-327600 | A | 11/1999 |
| JP | 2000-047850 | A | 2/2000 |
| JP | 2002-141805 | A | 5/2002 |
| JP | 2002-300042 | A | 10/2002 |
| JP | 2002-344316 | A | 11/2002 |
| JP | 2004-226742 | A | 8/2004 |

(Continued)

OTHER PUBLICATIONS

Carrano et al., 'Data Abstraction and Problem Solving with C++', Second Edition, Aug. 1998, pp. 51-53, 78-87, 4-2-403,598-613.*

(Continued)

*Primary Examiner* — Qi Han
(74) *Attorney, Agent, or Firm* — Wolf, Greenfield & Sacks, P.C.

(57) ABSTRACT

A computation apparatus includes: a range calculation section for calculating a range of an input value that can give a predetermined discrete value obtained by discretizing a computation result of a nonlinear operation; and a discrete value output section for outputting, when the input value is input, the predetermined discrete value corresponding to the range in which the input value that has been input is contained.

12 Claims, 17 Drawing Sheets

(56) References Cited

FOREIGN PATENT DOCUMENTS

| | | | |
|---|---|---|---|
| JP | 2006-047561 | | 2/2006 |
| JP | 3877683 | B2 | 11/2006 |
| JP | 2007-233554 | A | 9/2007 |
| JP | 2008-191675 | A | 8/2008 |

OTHER PUBLICATIONS

Tomas Alexander, GPU Gems 3 Japanese edition first edition, Book, Born digital Co., Ltd., Aug. 15, 2008.

Toshikazu Tajimi, "Programming Technique 7", UNIX Magazine, Japan, ASCII Co., Ltd., May 1, 1998, vol. 13, No. 5.

Yasunari Fujita, "Development of the Multimedia Interactive Art Authoring Environment", Information Processing Society article magazine, Japan, Information Processing Society of Japan, Mar. 15, 1995, vol. 36 No. 3.

Junichi Aoe, "Key Search Technique—I", Information processing vol. 33 No. 11, Journal of Information Processing Society of Japan, Japan, Information Processing Society of Japan, vol. 33.

* cited by examiner

FIG. 5

181

```
1       if (r[i] < -0.9829731F) {
2           index[i] = -7;
3           rq[i] = -0.9618257F;
4       } else if (r[i] < -0.9324722F) {
5           index[i] = -6;
6           rq[i] = -0.8951633F;
7       } else if (r[i] < -0.8502172F) {
8           index[i] = -5;
9           rq[i] = -0.7980172F;
10      } else if (r[i] < -0.7390089F) {
11          index[i] = -4;
12          rq[i] = -0.6736956F;
13      } else if (r[i] < -0.6026346F) {
14          index[i] = -3;
15          rq[i] = -0.5264322F;
16      } else if (r[i] < -0.4457384F) {
17          index[i] = -2;
18          rq[i] = -0.3612417F;
19      } else if (r[i] < -0.2736630F) {
20          index[i] = -1;
21          rq[i] = -0.1837495F;
22      } else if (r[i] < 0.1045285F) {
23          index[i] = 0;
24          rq[i] = 0.0000000F;
25      } else if (r[i] < 0.3090170F) {
26          index[i] = 1;
27          rq[i] = 0.2079117F;
28      } else if (r[i] < 0.5000001F) {
29          index[i] = 2;
30          rq[i] = 0.4067366F;
31      } else if (r[i] < 0.6691306F) {
32          index[i] = 3;
33          rq[i] = 0.5877852F;
34      } else if (r[i] < 0.8090171F) {
35          index[i] = 4;
36          rq[i] = 0.7431449F;
37      } else if (r[i] < 0.9135455F) {
38          index[i] = 5;
39          rq[i] = 0.8660255F;
40      } else if (r[i] < 0.9781476F) {
41          index[i] = 6;
42          rq[i] = 0.9510565F;
43      } else {
44          index[i] = 7;
45          rq[i] = 0.9945219F;
46      }
```

FIG. 9

281

```
float arcsin_Q_table[15]
= {
     -0.9829731F, -0.9324722F, -0.8502172F, -0.7390089F, -0.6026346F,
     -0.4457384F, -0.2736630F,  0.1045285F,  0.3090170F,  0.5000001F,
      0.6691306F,  0.8090170F,  0.9135455F,  0.9781476F,  1.0000000F
  };
float sin_Q_table[15]
= {
     -0.9618257F, -0.8951633F, -0.7980172F, -0.6736956F, -0.5264322F,
     -0.3612417F, -0.1837495F,  0.0000000F,  0.2079117F,  0.4067366F,
      0.5877852F,  0.7431449F,  0.8660255F,  0.9510565F,  0.9945219F
  };
    for (k = 0; k < 15; k++) {
        if (r[i] < arcsin_Q_table[k]) {
            index[i] = k - 7;
            rq[i] = sin_Q_table[k];
            break;
        }
  }
```

FIG. 10

291

```
short arcsin_Q_table_int[15]
= {
     -32209, -30554, -27859, -24215, -19746,
     -14605,  -8967,   3425,  10125,  16383,
      21925,  26509,  29934,  32050,  32767
  };
short sin_Q_table_int[15]
= {
     -31516, -29331, -26148, -22074, -17249,
     -11836,  -6020,      0,   6812, 1 3327,
      19259,  24350,  28377,  31163,  32587
  };
    for (k = 0; k < 15; k++) {
        if (r[i] < arcsin_Q_table_int[k]) {
            index[i] = k - 7;
            rq[i] = sin_Q_table_int[k];
            break;
        }
  }
```

FIG. 14

381

```
int hash_table[8]
= {
    0, 3, 5, 6, 7, 8, 9, 11
  };
    T = (int)((r[i] + 1.0F) * 4.0F);
    k = hash_table[T];
    for (; k < 15; k++) {
        if (r[i] < arcsin_Q_table[k]) {
            index[i] = k - 7;
            rq[i] = sin_Q_table[k];
            break;
        }
  }
```

| TECHNIQUE | NUMBER OF CYCLES | RATIO |
|---|---|---|
| TRIGONOMETRIC FUNCTION (RELATED ART) | 18657 | 1.00 |
| CONDITIONAL STATEMENT | 4537 | 0.24 |
| CONDITIONAL STATEMENT (BINARY SEARCHING) | 1980 | 0.11 |
| TABLE (WITHOUT HASH TABLE) | 7450 | 0.40 |
| TABLE (WITH HASH TABLE) | 3854 | 0.21 |

COMPUTATION APPARATUS AND METHOD, QUANTIZATION APPARATUS AND METHOD, AUDIO ENCODING APPARATUS AND METHOD, AND PROGRAM

BACKGROUND OF THE INVENTION

1. Field of the Invention

The present invention relates to a computation apparatus and method, a quantization apparatus and method, an audio encoding apparatus and method, and a program, and in particular to a computation apparatus and method, a quantization apparatus and method, an audio encoding apparatus and method, and a program that enables a computation process to be performed more efficiently.

2. Description of the Related Art

The MPEG (Moving Picture Expert Group) Audio Standard is known as a scheme for encoding an audio signal. The MPEG Audio Standard includes a plurality of encoding schemes, among which an encoding scheme called "MPEG-2 Audio Standard AAC (Advanced Audio Coding)" is standardized in ISO/IEC (International Organization for Standardization/International Electrotechnical Commission) 13818-7.

Another encoding scheme called "MPEG-4 Audio Standard AAC" is also standardized in the broader ISO/IEC 14496-3. Hereinafter, the MPEG-2 Audio Standard AAC and the MPEG-4 Audio Standard AAC are collectively referred to as an "AAC standard".

An audio encoding apparatus of the related art that complies with the AAC standard includes a psychoacoustic model holding section, a gain control section, a spectrum processing section, a quantization/encoding section, and a multiplexer section.

The psychoacoustic model holding section divides an audio signal input to the audio encoding apparatus into blocks along the time axis, and analyzes the audio signal for each divided band in accordance with human auditory characteristics to calculate the tolerable error intensity for each divided band.

Meanwhile, the gain control section divides the input audio signal into four equally spaced frequency bands, and performs gain adjustment on the audio signal for a predetermined band.

The spectrum processing section converts the audio signal which has been subjected to the gain adjustment into frequency-domain spectrum data, and performs a predetermined process on the spectrum data on the basis of the tolerable error intensity calculated by the psychoacoustic model holding section. The quantization/encoding section converts the spectrum data (audio signal) which have been subjected to the predetermined process into a code string, on which the multiplexer section multiplexes various information to output a bit stream.

The spectrum processing section discussed above performs a process called "TNS (Temporal Noise Shaping) process" on the frequency-domain spectrum data to control the waveform of quantization noise on the time axis.

For the TNS process, in particular, it has been proposed that the frequency-domain spectrum data be predicted using an FM synthesis scheme capable of expressing a complicated waveform using fewer parameters than those used in linear prediction, a residual signal is obtained as the differential from this signal, and the parameters and the residual signal are encoded, achieving a more efficient encoding process than a process using linear prediction (see Japanese Unexamined Patent Application Publication No. 2006-47561, for example).

SUMMARY OF THE INVENTION

Because the TNS process discussed above uses a nonlinear function such as an arcsin function and a sin function, however, its algorithm may be complicated and a great number of cycles may be performed.

Because a CPU (Central Processing Unit) and/or a DSP (Digital Signal Processor) installed in the audio encoding apparatus discussed above has a low operating frequency of several hundred Hz rather than a CPU of a personal computer, it is desirable to avoid the use of a function for which a great number of cycles may be performed such as functions in a math library.

It is therefore desirable to allow a computation process to be performed more efficiently.

According to a first embodiment of the present invention, there is provided a computation apparatus including: range calculation means for calculating a range of an input value that can give a predetermined discrete value obtained by discretizing a computation result of a nonlinear operation; and discrete value output means for outputting, when the input value is input, the predetermined discrete value corresponding to the range in which the input value that has been input is contained.

The computation apparatus may further include range table preparation means for preparing a range table in which the range of the input value and the predetermined discrete value are correlated, and the discrete value output means may output the predetermined discrete value corresponding to the range in which the input value that has been input is contained on the basis of the range table.

The computation apparatus may further include hash table preparation means for preparing a hash table on the basis of the range table, and the discrete value output means may specify an initial search value for the range table on the basis of the hash table, and may output the predetermined discrete value corresponding to the range in which the input value that has been input is contained on the basis of the initial search value and the range table.

The discrete value output means may perform a binary search of the range in which the input value that has been input is contained, and may output the predetermined discrete value corresponding to the searched range.

The range calculation means may calculate the range of the input value corresponding to the predetermined discrete value in advance.

According to the first embodiment of the present invention, there is provided a computation method including the steps of: calculating a range of an input value that can give a predetermined discrete value obtained by discretizing a computation result of a nonlinear operation; and when the input value is input, outputting the predetermined discrete value corresponding to the range in which the input value that has been input is contained.

According to the first embodiment of the present invention, there is provided a program for causing a computer to execute a process including the steps of: calculating a range of an input value that can give a predetermined discrete value obtained by discretizing a computation result of a nonlinear operation; and when the input value is input, outputting the predetermined discrete value corresponding to the range in which the input value that has been input is contained.

According to a second embodiment of the present invention, there is provided a quantization apparatus including: range calculation means for calculating a range of an input value that can give a predetermined quantized value obtained by quantizing a computation result of a nonlinear operation; and quantized value output means for outputting, when the input value is input, the predetermined quantized value corresponding to the range in which the input value that has been input is contained.

According to the second embodiment of the present invention, there is provided a quantization method including the steps of: calculating a range of an input value that can give a predetermined quantized value obtained by quantizing a computation result of a nonlinear operation; and when the input value is input, outputting the predetermined quantized value corresponding to the range in which the input value that has been input is contained.

According to the second embodiment of the present invention, there is provided a program for causing a computer to execute a process including the steps of: calculating a range of an input value that can give a predetermined quantized value obtained by quantizing a computation result of a nonlinear operation; and when the input value is input, outputting the predetermined quantized value corresponding to the range in which the input value that has been input is contained.

According to a third embodiment of the present invention, there is provided an audio encoding apparatus including: linear prediction means for performing a linear prediction on frequency-domain spectrum data obtained by converting an audio signal to obtain a reflection coefficient; quantization means for quantizing the reflection coefficient to obtain a quantized value and inversely quantizing the quantized value to obtain an inverse quantized value; range calculation means for calculating a range of the reflection coefficient that can give a predetermined quantized value in advance; coefficient conversion means for converting the inverse quantized value into a linear prediction coefficient; and residual signal calculation means for calculating a residual signal between the spectrum data and the spectrum data that have been subjected to the linear prediction using the linear prediction coefficient, in which when the reflection coefficient is input, the quantization means obtains the predetermined quantized value corresponding to the range in which the reflection coefficient that has been input is contained.

According to the third embodiment of the present invention, there is provided an audio encoding method including the steps of: performing a linear prediction on frequency-domain spectrum data obtained by converting an audio signal to obtain a reflection coefficient; quantizing the reflection coefficient to obtain a quantized value and inversely quantizing the quantized value to obtain an inverse quantized value; calculating a range of the reflection coefficient that can give a predetermined quantized value in advance; converting the inverse quantized value into a linear prediction coefficient; and calculating a residual signal between the spectrum data and the spectrum data that have been subjected to the linear prediction using the linear prediction coefficient, in which when the reflection coefficient is input in the quantization step, the predetermined quantized value corresponding to the range in which the reflection coefficient that has been input is contained is obtained.

According to the third embodiment of the present invention, there is provided a program for causing a computer to execute a process including the steps of: performing a linear prediction on frequency-domain spectrum data obtained by converting an audio signal to obtain a reflection coefficient; quantizing the reflection coefficient to obtain a quantized value and inversely quantizing the quantized value to obtain an inverse quantized value; calculating a range of the reflection coefficient that can give a predetermined quantized value in advance; converting the inverse quantized value into a linear prediction coefficient; and calculating a residual signal between the spectrum data and the spectrum data that have been subjected to the linear prediction using the linear prediction coefficient, in which when the reflection coefficient is input in the quantization step, the predetermined quantized value corresponding to the range in which the reflection coefficient that has been input is contained is obtained.

In the first embodiment of the present invention, the range of an input value that can give a predetermined discrete value obtained by discretizing the computation result of a nonlinear operation is calculated, and when the input value is input, the predetermined discrete value corresponding to the range in which the input value that has been input is contained is output.

In the second embodiment of the present invention, the range of an input value that can give a predetermined quantized value obtained by quantizing the computation result of a nonlinear operation is calculated, and when the input value is input, the predetermined quantized value corresponding to the range in which the input value that has been input is contained is output.

In the third embodiment of the present invention, a linear prediction is performed on frequency-domain spectrum data obtained by converting an audio signal to obtain a reflection coefficient; the reflection coefficient is quantized to obtain a quantized value and the quantized value is inversely quantized to obtain an inverse quantized value; the range of the reflection coefficient that can give a predetermined quantized value is calculated in advance; the inverse quantized value is converted into a linear prediction coefficient; a residual signal between the spectrum data and the spectrum data that have been subjected to the linear prediction is calculated using the linear prediction coefficient; and when the reflection coefficient is input, the predetermined quantized value corresponding to the range in which the reflection coefficient that has been input is contained is obtained.

According to the first and second embodiments of the present invention, it is possible to perform a computation process more efficiently.

According to the third embodiment of the present invention, it is possible to perform a TNS process more efficiently.

BRIEF DESCRIPTION OF THE DRAWINGS

FIG. 5 shows an exemplary program, written in the C language, for a process performed in step S53 of the flowchart of FIG. 4;

FIG. 9 shows an exemplary program, written in the C language, for a process performed in step S53 of the flowchart of FIG. 8;

FIG. 10 shows an exemplary program, written in the C language, for a case where fixed-point numbers are used in place of floating-point numbers in the exemplary program of FIG. 9;

FIG. 14 shows an exemplary program, written in the C language, for a process performed in step S253 of the flowchart of FIG. 13;

DESCRIPTION OF THE PREFERRED EMBODIMENTS

An embodiment of the present invention will be described below with reference to the drawings. The description will be made in the following order.

1. First Embodiment
2. Second Embodiment
3. Third Embodiment
4. Execution Results
5. Fourth Embodiment

1. First Embodiment

Exemplary Configuration of Audio Encoding Apparatus

Figure 1:
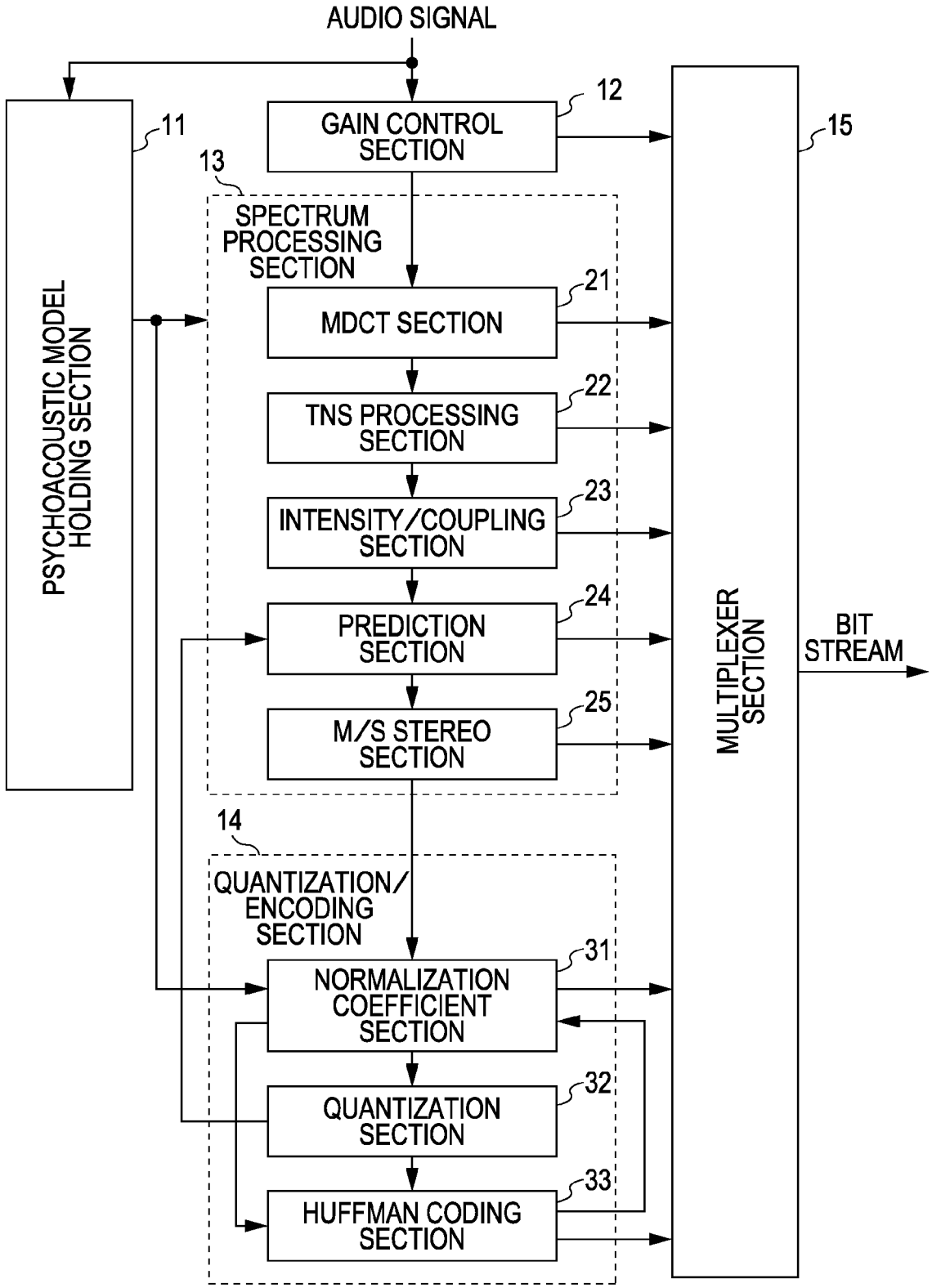
FIG. 1 is a block diagram showing an exemplary configuration of an audio encoding apparatus according to an embodiment of the present invention.

FIG. 1 shows the configuration of an audio encoding apparatus according to an embodiment of the present invention.

The audio encoding apparatus of FIG. 1 complies with the AAC standard, and includes a psychoacoustic model holding section 11, a gain control section 12, a spectrum processing section 13, a quantization/encoding section 14, and a multiplexer section 15.

An audio signal input to the audio encoding apparatus is supplied to the psychoacoustic model holding section 11 and the gain control section 12. The psychoacoustic model holding section 11 divides the input audio signal into blocks along the time axis, and analyzes the audio signal in the form of blocks for each divided band in accordance with human auditory characteristics to calculate the tolerable error intensity for each divided band. The psychoacoustic model holding section 11 supplies the calculated tolerable error intensity to the spectrum processing section 13 and the quantization/encoding section 14.

Of the three profiles prepared as encoding algorithms according to the AAC standard, namely the Main, LC (Low Complexity), and SSR (Scalable Sampling Rate) profiles, the gain control section 12 is used only for the SSR profile. The gain control section 12 divides the input audio signal into four equally spaced frequency bands, and performs gain adjustment on the audio signal for bands other than the lowest band, for example, to supply the adjustment results to the spectrum processing section 13.

The spectrum processing section 13 converts the audio signal which has been subjected to the gain adjustment performed by the gain control section 12 into frequency-domain spectrum data. The spectrum processing section 13 also controls its sub-components on the basis of the tolerable error intensity supplied from the psychoacoustic model holding section 11 to perform a predetermined process on the spectrum data.

The spectrum processing section 13 includes an MDCT (Modified Discrete Cosine Transform) section 21, a TNS (Temporal Noise Shaping) processing section 22, an intensity/coupling section 23, a prediction section 24, and an M/S stereo (Middle/Side Stereo) section 25.

The MDCT section 21 converts the time-domain audio signal supplied from the gain control section 12 into frequency-domain spectrum data (MDCT coefficient), and supplies the conversion results to the TNS processing section 22. The TNS processing section 22 performs linear prediction on the spectrum data from the MDCT section 21 as if the spectrum data were a time-domain signal to apply prediction filtering to the spectrum data, and supplies the filtered results to the intensity/coupling section 23 as a bit stream. The intensity/coupling section 23 performs a compression process (stereo correlation encoding process) on the audio signal from the TNS processing section 22 as spectrum data utilizing the correlation between different channels.

The prediction section 24 is used only for the Main profile, of the three profiles discussed above. The prediction section 24 performs predictive encoding using the audio signal which has been subjected to the stereo correlation encoding performed by the intensity/coupling section 23 and the audio signal supplied from the quantization/encoding section 14, and supplies the resulting audio signal to the M/S stereo section 25. The M/S stereo section 25 performs stereo correlation encoding on the audio signal from the prediction section 24, and supplies the encoding results to the quantization/encoding section 14.

The quantization/encoding section 14 includes a normalization coefficient section 31, a quantization section 32, and a Huffman coding section 33. The quantization/encoding section 14 converts the audio signal from the M/S stereo section 25 of the spectrum processing section 13 into a code string, and supplies the conversion results to the multiplexer section 15.

The normalization coefficient section 31 supplies the audio signal from the M/S stereo section 25 to the quantization section 32. The normalization coefficient section 31 also calculates a normalization coefficient for use in quantization of the audio signal on the basis of the audio signal, and supplies the calculation results to the quantization section 32 and the Huffman coding section 33. In the quantization apparatus of FIG. 1, for example, the tolerable error intensity from the psychoacoustic model holding section 11 is used to calculate a quantization step parameter as a normalization coefficient for each divided band.

The quantization section 32 performs nonlinear quantization on the audio signal supplied from the normalization coefficient section 31 using the normalization coefficient from the normalization coefficient section 31, and supplies the resulting audio signal (quantized value) to the Huffman coding section 33 and the prediction section 24. The Huffman coding section 33 converts the normalization coefficient from the normalization coefficient section 31 and the quantized value from the quantization section 32 into Huffman codes on the basis of a predefined Huffman code table, and supplies the Huffman codes to the multiplexer section 15.

The multiplexer section 15 multiplexes the various information generated in the course of audio signal encoding and supplied from the gain control section 12 and the MDCT section 21 through the normalization coefficient section 31 and the Huffman codes from the Huffman coding section 33 to generate and output a bit stream for the audio signal.

[Exemplary Configuration of TNS Processing Section]

An exemplary configuration of the TNS processing section 22 is next described with reference to the block diagram of FIG. 2.

Figure 2:
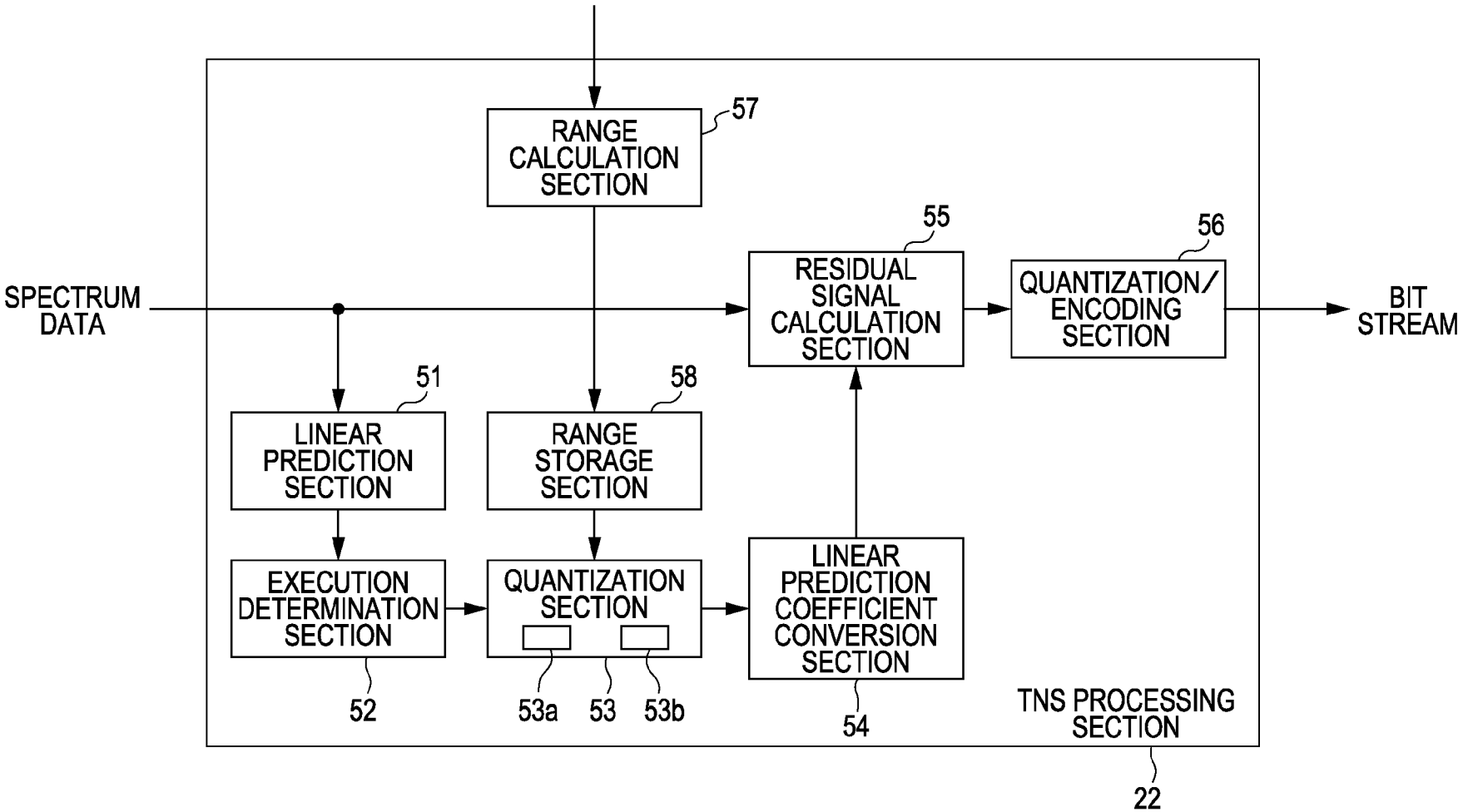
FIG. 2 is a block diagram showing an exemplary configuration of a TNS processing section in the audio encoding apparatus of FIG. 1.

The TNS processing section 22 of FIG. 2 includes a linear prediction section 51, an execution determination section 52, a quantization section 53, a linear prediction coefficient conversion section 54, a residual signal calculation section 55, and a quantization/encoding section 56.

The linear prediction section 51 performs linear prediction for the (TNS_MAX_ORDER)-th order using the frequency-domain spectrum data (MDCT coefficient) x[n] from the MDCT section 21, and supplies the resulting prediction gain and reflection coefficient r[i] (i=0, . . . , TNS_MAX_ORDER−1) to the execution determination section 52.

The execution determination section 52 determines whether or not the linear prediction section 51 has performed the linear prediction correctly in correspondence with whether or not the prediction gain from the linear prediction section 51 is greater than a predetermined threshold. If it is determined that the linear prediction section 51 has performed the linear prediction correctly, that is, if a TNS process is executable, the execution determination section 52 supplies the reflection coefficient r[i] from the linear prediction section 51 to the quantization section 53.

A quantization section in a TNS processing section in the related art is now described.

The quantization section in the TNS processing section in the related art quantizes the reflection coefficient r[i] from the execution determination section using a quantization bit rate coef_res, and further inversely quantizes the resulting quantized value index[i]. The quantization section also supplies the quantized value index[i] obtained as a result of the quantization and an inverse quantized value rq[i] obtained as a result of the inverse quantization to the linear prediction coefficient conversion section.

The quantized value index[i] and the inverse quantized value rq[i] are respectively represented by the following formulas (1) and (2):

[Formula 1]

$$\text{index}[i]=(\text{int})\{\arcsin(r[i])\times Q\} \tag{1}$$

[Formula 2]

$$rq[i]=\sin(\text{index}[i]/Q) \tag{2}$$

In the formula (1), (int)(X) represents a function for extracting the integer part of a floating-point number X. The parameter Q indicates a quantization step, and is represented by the following formulas (3) to (5):

[Formula 3]

$$Q=\begin{cases}\text{iqfac_p} & r[i]\geq 0\\ \text{iqfac_m} & r[i]<0\end{cases} \tag{3}$$

[Formula 4]

$$\text{iqfac_p}=\frac{2^{coef_res-1}-0.5}{\pi/2} \tag{4}$$

[Formula 5]

$$\text{iqfac_m}=\frac{2^{coef_res-1}+0.5}{\pi/2} \tag{5}$$

That is, the quantization section in the TNS processing section in the related art quantizes the reflection coefficient r[i] using an arcsin function which is a nonlinear function through the quantization step indicated by the parameter Q as indicated by the formula (1), and inversely quantizes the resulting quantized value index[i] using a sin function as indicated by the formula (2).

Because the quantization section in the TNS processing section in the related art discussed above uses an arcsin function and a sin function, its algorithm may be complicated and a great number of cycles may be performed.

Returning to the block diagram of FIG. 2, the quantization section 53 includes a specifying section 53*a* and a deciding section 53*b*. The specifying section 53*a* specifies the range in which the reflection coefficient r[i] supplied from the execution determination section 52 is contained by sequentially reading the range of the reflection coefficient and the corresponding quantized value index[i] and inverse quantized value rq[i] stored in a range storage section 58. The deciding section 53*b* decides the quantized value index[i] and the inverse quantized value rq[i] correlated with the range specified by the specifying section 53*a*, and supplies the decided values to the linear prediction coefficient conversion section 54.

The linear prediction coefficient conversion section 54 calculates an order TNS_ORDER at which the absolute value of the inverse quantized value rq[i] from the quantization section 53 becomes greater than a predetermined threshold, as an order for use in calculation performed by the residual signal calculation section 55. The linear prediction coefficient conversion section 54 also converts the inverse quantized value rq[i] into a linear prediction coefficient a[i] of the (TNS_ORDER+1)-th order, and supplies the conversion results to the residual signal calculation section 55 along with the quantized value index[i] from the quantized value 53.

The residual signal calculation section 55 calculates a residual signal y[n] between the spectrum data x[n] from the MDCT section 21 and the linear prediction coefficient a[i] from the linear prediction coefficient conversion section 54, and supplies the residual signal y[n] to the quantization/encoding section 56 along with the quantized value from the linear prediction coefficient conversion section 54.

The quantization/encoding section 56 converts the order TNS_ORDER of the linear prediction coefficient, the quantized value index[i] of the reflection coefficient, and the residual signal y[n] into a bit stream on the basis of the residual signal y[n] and the quantized value index[i] from the residual signal calculation section 55, and supplies the bit stream to the intensity/coupling section 23 and the multiplexer section 15.

A range calculation section 57 calculates the range of the reflection coefficient corresponding to the quantized value. More specifically, the range calculation section 57 calculates the range of the reflection coefficient r[i] that may give each quantized value index[i] indicated by the formula (1) (the reflection coefficient r[i] with the quantized value index[i] varied). The range calculation section 57 also inversely quantizes each quantized value to calculate the inverse quantized value rq[i] corresponding to the quantized value. The range calculation section 57 correlates the quantized value index[i] and the inverse quantized value rq[i] with the range of the reflection coefficient r[i], and stores the correlation results in the range storage section 58.

The range storage section 58 stores the range of the reflection coefficient r[i] along with the corresponding quantized value index[i] and inverse quantized value rq[i].

According to the above configuration, the TNS processing section 22 decides the quantized value and the inverse quantized value corresponding to the reflection coefficient obtained from the input spectrum data on the basis of the range of the reflection coefficient and the corresponding quantized value and inverse quantized value stored in advance.

In order to decode the result of the encoding process performed by the encoding apparatus including the TNS processing section discussed above, the order TNS_ORDER of the linear prediction coefficient, the quantized value index[i] of the reflection coefficient, and the residual signal y[n] are first decoded. Spectrum data are calculated from the decoding results, and are subjected to an inverse MDCT process, obtaining an audio signal.

Quantization noise contained in the audio signal obtained from the inverse MDCT process is distributed at portions of the waveform with a large amplitude (high signal level) on the time axis as a result of a TNS process. That is, the TNS process makes the quantization noise lower at portions where the audio signal produces sound at a low volume and higher at portions where the audio signal produces sound at a high volume, making the quantization noise contained in the audio signal inconspicuous. It is thus possible to reduce deterioration in sound quality called "pre-echo".

[Range Calculation Process Performed by TNS Processing Section]

Figure 3:
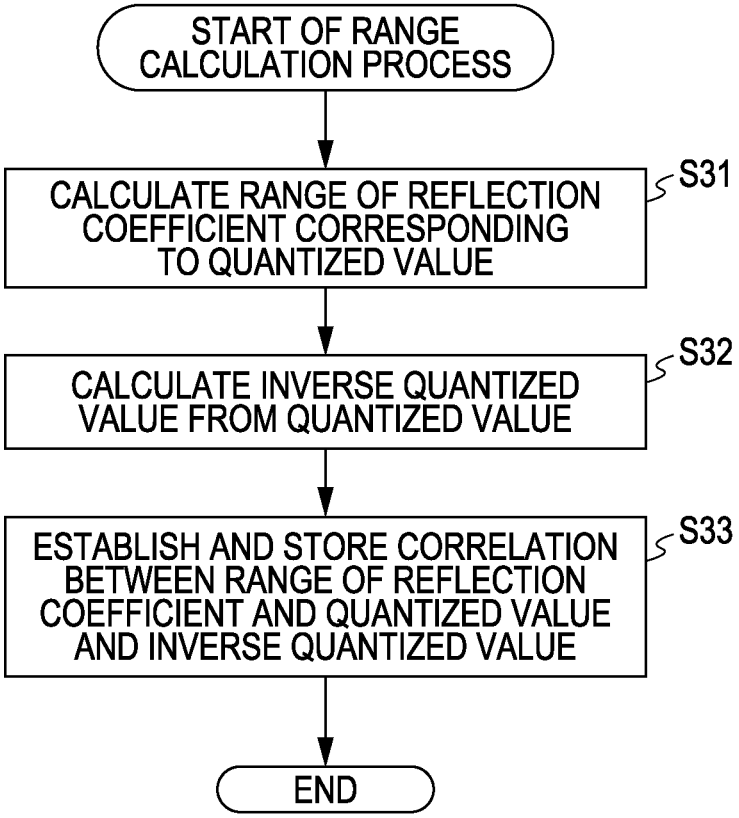
FIG. 3 is a flowchart illustrating a range calculation process performed by the TNS processing section of FIG. 2.

A range calculation process performed by the TNS processing section 22 of FIG. 2 is next described with reference to the flowchart of FIG. 3. The TNS processing section 22 performs the range calculation process before performing the TNS process.

In step S31, the range calculation section 57 calculates the range of the reflection coefficient corresponding to the quantized value. More specifically, the range calculation section 57 calculates the range of the reflection coefficient r[i] that may give each quantized value index[i] indicated by the formula (1). Here, it is assumed that the quantization bit rate coef_res in the formula (1) is 4 bits.

In step S32, the range calculation section 57 calculates the inverse quantized value rq[i] corresponding to the quantized value index[i] by inversely quantizing the quantized value index[i].

In step S33, the range calculation section 57 correlates the quantized value index[i] and the inverse quantized value rq[i] with the range of the reflection coefficient r[i], and stores the correlation results in the range storage section 58.

As a result of the above process, it is possible to establish and store the correlation between the range of the reflection coefficient and the quantized value index[i] and the inverse quantized value rq[i] before the TNS process is performed.

[TNS Process Performed by TNS Processing Section]

A TNS process performed by the TNS processing section 22 of FIG. 2 is next described with reference to the flowchart of FIG. 4.

In step S51, the linear prediction section 51 performs linear prediction for the "TNS_MAX_ORDER"-th order using the frequency-domain spectrum data (MDCT coefficient) x[n] from the MDCT section 21, and supplies the resulting prediction gain and reflection coefficient r[i] (i=0, . . . , TNS_MAX_ORDER−1) to the execution determination section 52.

In step S52, the execution determination section 52 determines whether or not the linear prediction section 51 has performed the linear prediction correctly in correspondence with whether or not the prediction gain from the linear prediction section 51 is greater than a predetermined threshold. If it is determined that the linear prediction section 51 has performed the linear prediction correctly, that is, if a TNS process is executable, the execution determination section 52 supplies the reflection coefficient r[i] from the linear prediction section 51 to the quantization section 53. The process proceeds to step S53.

In step S53, the specifying section 53*a* of the quantization section 53 specifies the range in which the reflection coefficient r[i] supplied from the execution determination section 52 is contained by sequentially reading the range of the reflection coefficient and the corresponding quantized value index [i] and inverse quantized value rq[i] stored in the range storage section 58.

In step S54, the deciding section 53*b* of the quantization section 53 decides the quantized value index[i] and the inverse quantized value rq[i] correlated with the range specified by the specifying section 53*a*. The deciding section 53*b* supplies the decided quantized value index[i] and inverse quantized value rq[i] to the linear prediction coefficient conversion section 54.

In step S55, the linear prediction coefficient conversion section 54 calculates an order TNS_ORDER at which the absolute value of the inverse quantized value rq[i] from the quantization section 53 becomes greater than a predetermined threshold, as an order for use in calculation performed by the residual signal calculation section 55. The linear prediction coefficient conversion section 54 also converts the inverse quantized value rq[i] into a linear prediction coefficient a[i] of the (TNS_ORDER+1)-th order, and supplies the conversion results to the residual signal calculation section 55 along with the quantized value index[i] from the quantized value 53.

In step S56, the residual signal calculation section 55 calculates a residual signal y[n] between the spectrum data x[n] from the MDCT section 21 and the linear prediction coefficient a[i] from the linear prediction coefficient conversion section 54. The residual signal y[n] is represented by the following formula (6):

[Formula 6]

$$y[n] = x[n] + \sum_{k=1}^{TNS_ORDER} a[k] \times x[n-k] \tag{6}$$

The residual signal calculation section 55 supplies the calculated residual signal y[n] to the quantization/encoding section 56 along with the quantized value index[i] from the linear prediction coefficient conversion section 54.

In step S57, the quantization/encoding section 56 converts the order TNS_ORDER of the linear prediction coefficient, the quantized value index[i] of the reflection coefficient, and the residual signal y[n] into a bit stream on the basis of the residual signal y[n] and the quantized value index[i] from the residual signal calculation section 55, and supplies the bit stream to the intensity/coupling section 23 and the multiplexer section 15.

In this way, it is possible to execute the TNS process without using an arcsin function or a sin function.

Figure 4:
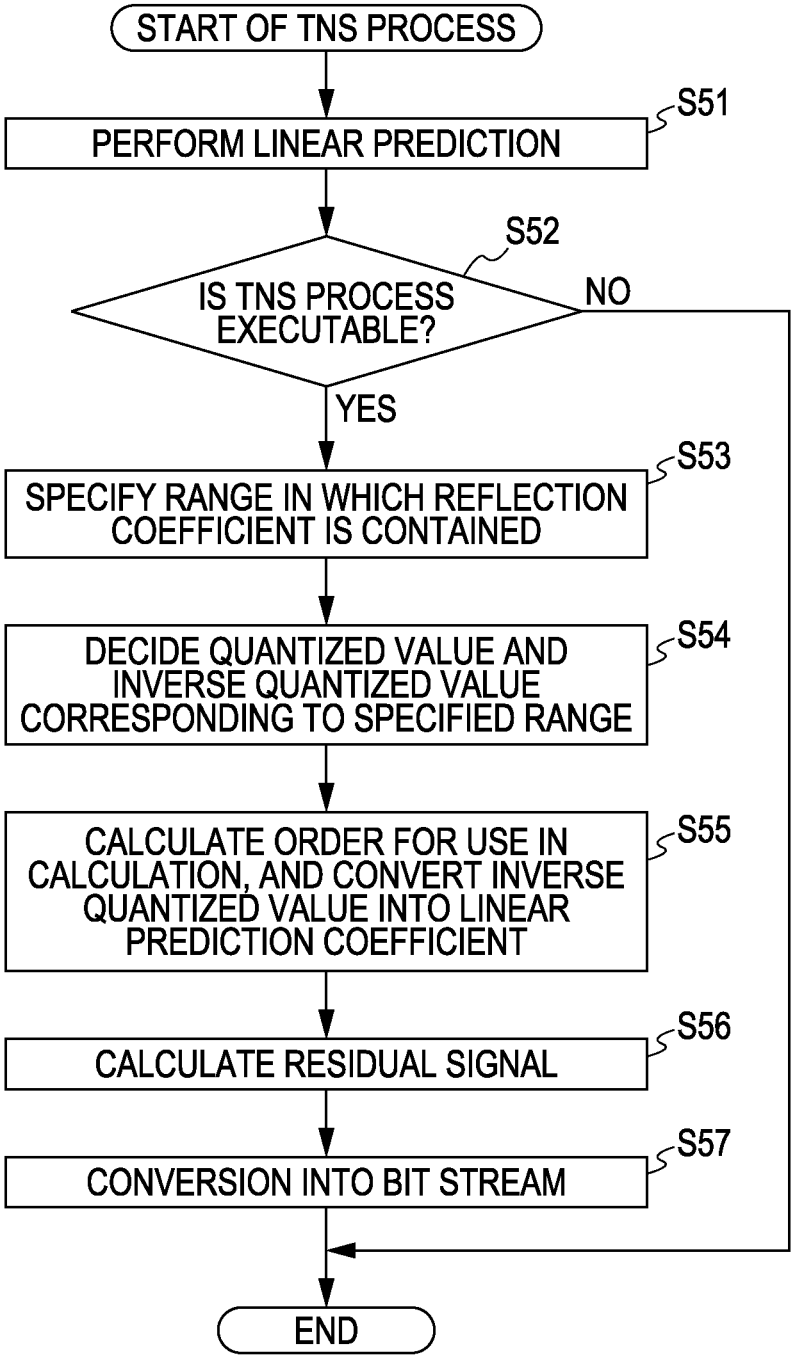
FIG. 4 is a flowchart illustrating a TNS process performed by the TNS processing section of FIG. 2.

FIG. 5 shows an exemplary program, written in the C language, for the processes performed in step S53 of the flowchart of FIG. 4.

In a program 181 of FIG. 5, the number on the left side of each line is the serial number of each line provided for the purpose of illustration. The numbers are thus not necessary in the actual program. This also applies to other exemplary programs provided subsequently.

In the lines 1 to 3 of the program 181, it is determined whether or not the reflection coefficient r[i] input at the i-th time is less than −0.9827931F. If the reflection coefficient r[i] is less than −0.982793F, the quantized value index[i]=−7 and the inverse quantized value rq[i]=−0.9618257, which are correlated with the range r[i]<−0.982973F of the reflection coefficient r[i], are decided.

If the reflection coefficient r[i] is not less than −0.982793F, on the other hand, it is determined in the lines 4 to 6 whether or not the reflection coefficient r[i] input at the i-th time is less than −0.9324722F. If the reflection coefficient r[i] is less than −0.9324722F, the quantized value index[i]=−6 and the inverse quantized value rq[i]=−0.8951633, which are correlated with the range −0.9829731F≤r[i]<−0.9324722F of the reflection coefficient r[i], are decided.

Subsequently, the range of the input reflection coefficient r[i] is determined sequentially from a small value in the same way so that the quantized value index[i] and the inverse quantized value rq[i] set to the range corresponding to that reflection coefficient r[i] are decided.

As a result of the above process, it is possible to decide the quantized value corresponding to the input spectrum data on the basis of the range of the reflection coefficient corresponding to the quantized value obtained in advance. It is thus possible to decide the quantized value without computation using an arcsin function which is a nonlinear function as indicated by the formula (1) but through searches using conditions as discussed above, enabling the TNS process to be performed more efficiently.

In the example described above, the quantized value is decided through 15 sequential searches using different conditions. However, the quantized value may be decided through as few as 4 determinations using binary searching in which each conditional statement divides the range into two.

The conditions for a search for the quantized value (the range of the reflection coefficient and the corresponding quantized value index[i] and inverse quantized value rq[i]) may be stored in a table (hereinafter referred to as "range table") to decide the quantized value on the basis of the range table.

2. Second Embodiment

Exemplary Configuration of TNS Processing Section

Figure 6:
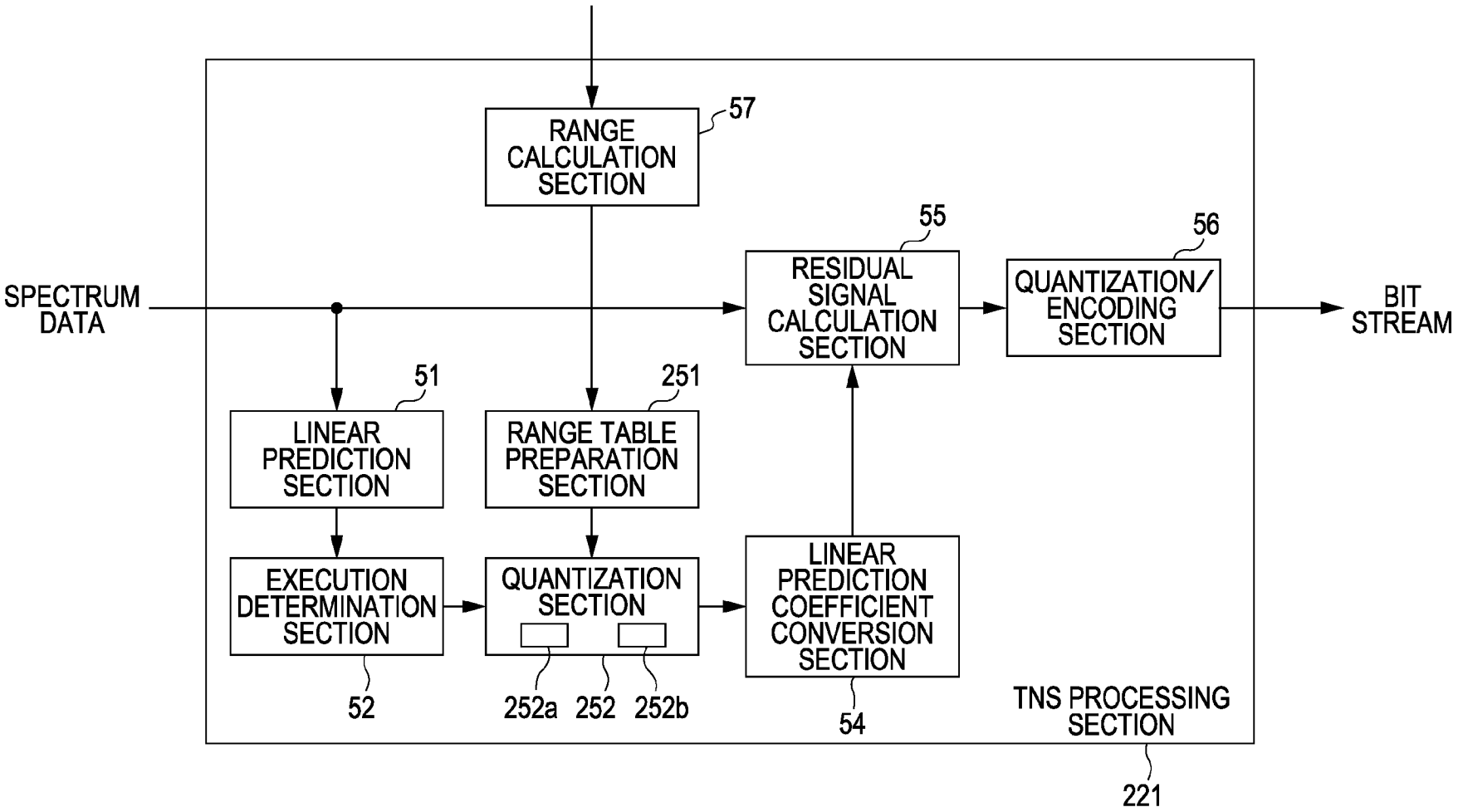
FIG. 6 is a block diagram showing another exemplary configuration of the TNS processing section.

FIG. 6 shows an exemplary configuration of a TNS processing section which decides the quantized value on the basis of a range table. Components of a TNS processing section 221 of FIG. 6 that are common to those of the TNS processing section 22 of FIG. 2 are given the same names and the same reference numerals, and their descriptions are omitted as appropriate.

The TNS processing section 221 of FIG. 6 is different from the TNS processing section 22 of FIG. 2 in including a range table preparation section 251 and a quantization section 252 in place of the quantization section 53 and the range storage section 58.

The range table preparation section 251 prepares a range table in which the quantized value index[i] and the inverse quantized value rq[i] are correlated with the range of the reflection coefficient r[i] from the range calculation section 57, and supplies the prepared range table to the quantization section 252.

The quantization section 252 includes a specifying section 252*a* and a deciding section 252*b*. The specifying section 252*a* specifies the range in which the reflection coefficient supplied from the execution determination section 52 is contained on the basis of the range of the reflection coefficient and the quantized value and the inverse quantized value in the range table supplied from the range table preparation section 251. The deciding section 252*b* decides the quantized value and the inverse quantized value correlated with the range specified by the specifying section 252*a*, and supplies the decided values to the linear prediction coefficient conversion section 54.

According to the above configuration, the TNS processing section 221 decides the quantized value and the inverse quantized value corresponding to the reflection coefficient obtained from the input spectrum data on the basis of the range of the reflection coefficient and the corresponding quantized value and inverse quantized value in the range table prepared in advance.

[Range Table Preparation Process Performed by TNS Processing Section]

Figure 7:
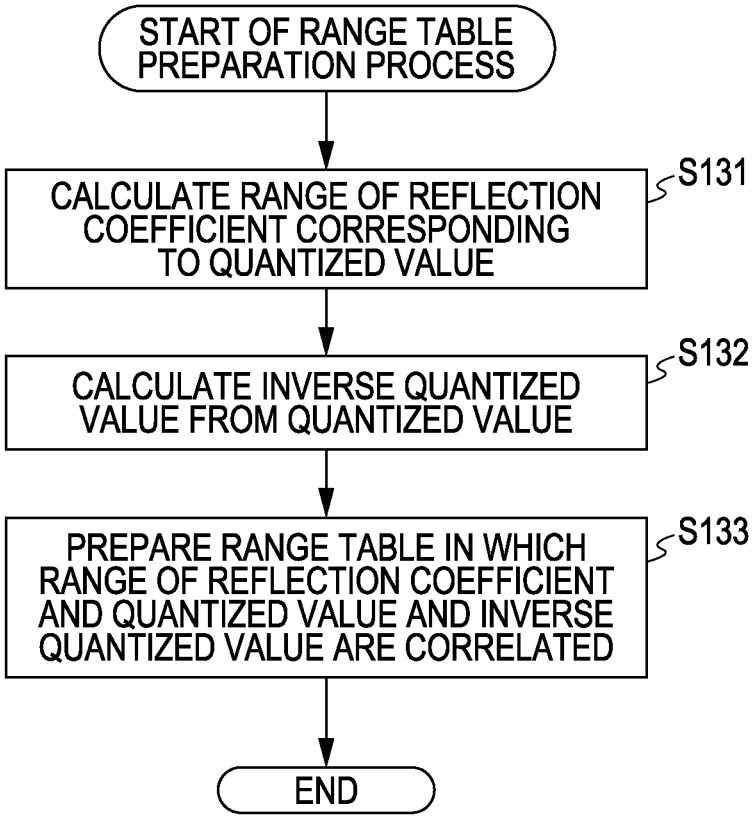
FIG. 7 is a flowchart illustrating a range table preparation process performed by the TNS processing section of FIG. 6.

A range table preparation process performed by the TNS processing section 221 of FIG. 6 is next described with reference to the flowchart of FIG. 7. The TNS processing section 221 performs the range table preparation process before performing the TNS process. The processes in steps S131, S132 of the flowchart of FIG. 7 are the same as those in steps S31, S32, respectively, described with reference to the flowchart of FIG. 3, and their descriptions are therefore omitted.

In step S133, the range table preparation section 251 prepares a range table in which the quantized value index[i] and the inverse quantized value rq[i] are correlated with the range of the reflection coefficient r[i] from the range calculation section 57, and supplies the prepared range table to the quantization section 252.

As a result of the above process, it is possible to prepare a range table in which the range of the reflection coefficient and the quantized value index[i] and the inverse quantized value rq[i] are correlated before the TNS process is performed.

[TNS Process Performed by TNS Processing Section]

Figure 8:
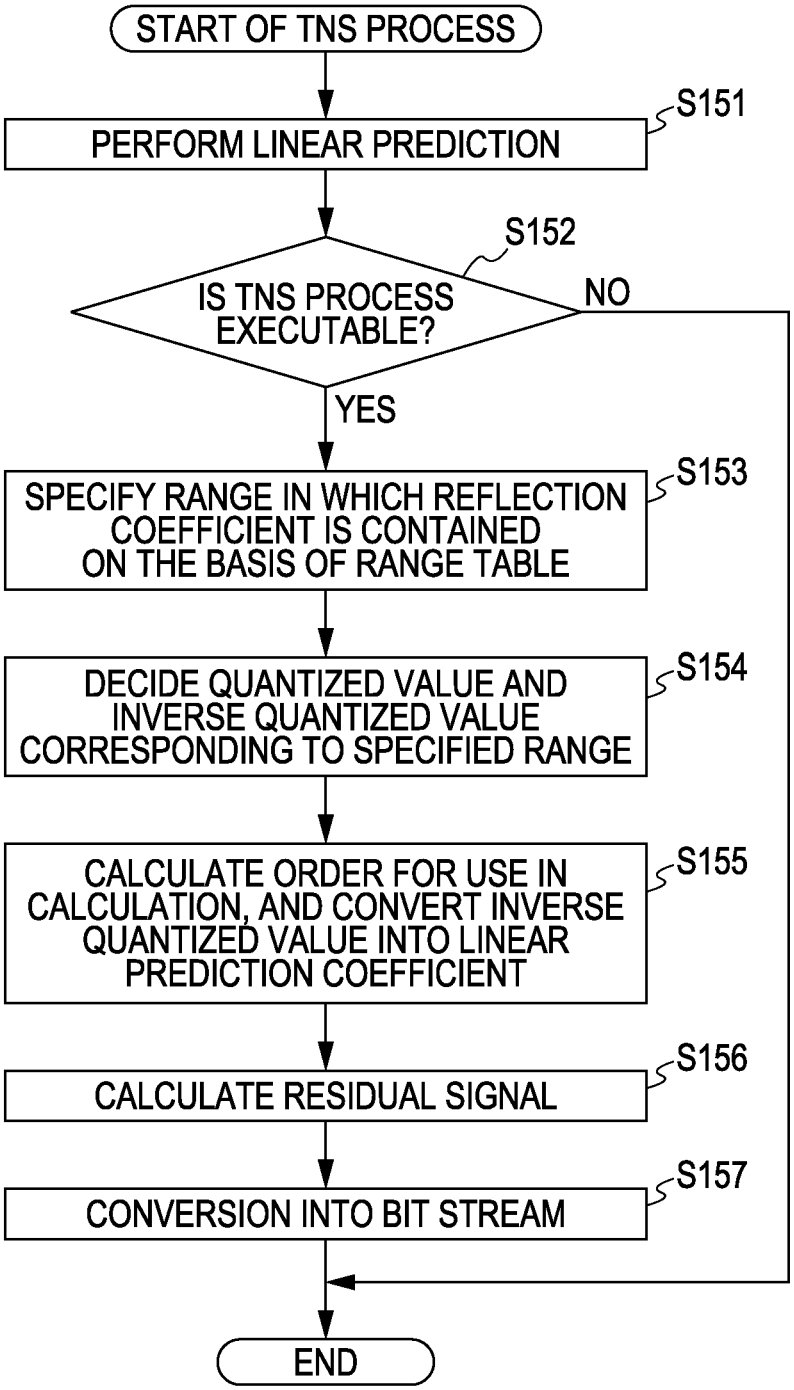
FIG. 8 is a flowchart illustrating a TNS process performed by the TNS processing section of FIG. 6.

A TNS process performed by the TNS processing section 221 of FIG. 6 is next described with reference to the flowchart of FIG. 8. The processes in steps S151, S152, S155 to S156 of the flowchart of FIG. 8 are the same as those in steps S51, S52, S55 to S57, respectively, described with reference to the flowchart of FIG. 4, and their descriptions are therefore omitted.

In step S153, the specifying section 252*a* of the quantization section 252 specifies the range in which the reflection coefficient r[i] supplied from the execution determination section 52 is contained on the basis of the range of the reflection coefficient r[i] and the quantized value index[i] and the inverse quantized value rq[i] in the range table supplied from the range table preparation section 251.

In step S154, the deciding section 252*b* decides the quantized value index[i] and the inverse quantized value rq[i] correlated with the range specified by the specifying section 252*a*, and supplies the decided values to the linear prediction coefficient conversion section 54.

In this way, it is possible to execute the TNS process without using an arcsin function or a sin function but using a range table.

FIG. 9 shows an exemplary program, written in the C language, for the processes performed in steps S153, S154 of the flowchart of FIG. 8.

In a program 281 of FIG. 9, "arcsin_Q_table[15]" in the lines 1 to 6 represents a table in which the range of the reflection coefficient r[i] and the quantized value index[i] (=k−7) are correlated. Meanwhile, "sin_Q_table[15]" in the lines 7 to 12 represents a table in which the quantized value index[i] (=k−7) and the inverse quantized value rq[i] are correlated. That is, the range table is constituted by "arcsin_Q_table[15]" and "sin_Q_table[15]" in the program 281.

In the lines 13 to 19, it is determined whether or not the reflection coefficient r[i] input at the i-th time is less than the k-th table value arcsin_Q_table[k] in the table of the lines 1 to 6. If the reflection coefficient r[i] is less than the table value arcsin_Q_table[k], the quantized value index[i]=k−7 and the inverse quantized value rq[i]=sin_Q_table[k] are decided.

By using a range table in this way, it is possible to reduce the number of statements for the program in the C language compared to the program 181 of FIG. 5.

As a result of the above process, it is possible to decide the quantized value corresponding to the input spectrum data on the basis of the range of the reflection coefficient corresponding to the quantized value obtained in advance. It is thus possible to decide the quantized value without computation using an arcsin function which is a nonlinear function as indicated by the formula (1) but through searches using a range table, enabling the TNS process to be performed more efficiently.

Although the values for the input data or in the table are treated as floating-point numbers in the above example, these values may also be treated as fixed-point numbers. More specifically, the range of input data corresponding to a discrete value may be calculated using floating-point numbers, on the basis of which the integer parts of fixed-point numbers may be calculated.

[Exemplary Application Using Fixed-Point Numbers]

FIG. 10 shows an exemplary program, written in the C language, for an exemplary case where the values of the floating-point numbers in the tables arcsin_Q_table[15], sin_Q_table[15] illustrated in FIG. 9 are represented as 16-bit fixed-point numbers.

In a program 291 of FIG. 10, "arcsin_Q_table_int[15]" in the lines 1 to 6 represents a table in which the range of the reflection coefficient r[i] and the quantized value index[i] (=k−7) are correlated. Meanwhile, "sin_Q_table_int[15]" in the lines 7 to 12 represents a table in which the quantized value index[i] (=k−7) and the inverse quantized value rq[i] are correlated. That is, the range table is constituted by "arcsin_Q_table_int[15]" and "sin_Q_table_int[15]" in the program 291.

The process of the lines 13 to 19 is the same as that of the lines 13 to 19 of the program 281 of FIG. 9, and its description is therefore omitted.

Also in the above example, it is possible to decide the quantized value without computation using an arcsin function which is a nonlinear function as indicated by the formula (1) but through searches using a range table containing fixed-point numbers, enabling the TNS process to be performed more efficiently.

Although a quantized value matching a reflection coefficient is searched for using a range table in the above example, it is possible to further efficiently search for a quantized value.

3. Third Embodiment

Exemplary Configuration of TNS Processing Section

Figure 11:
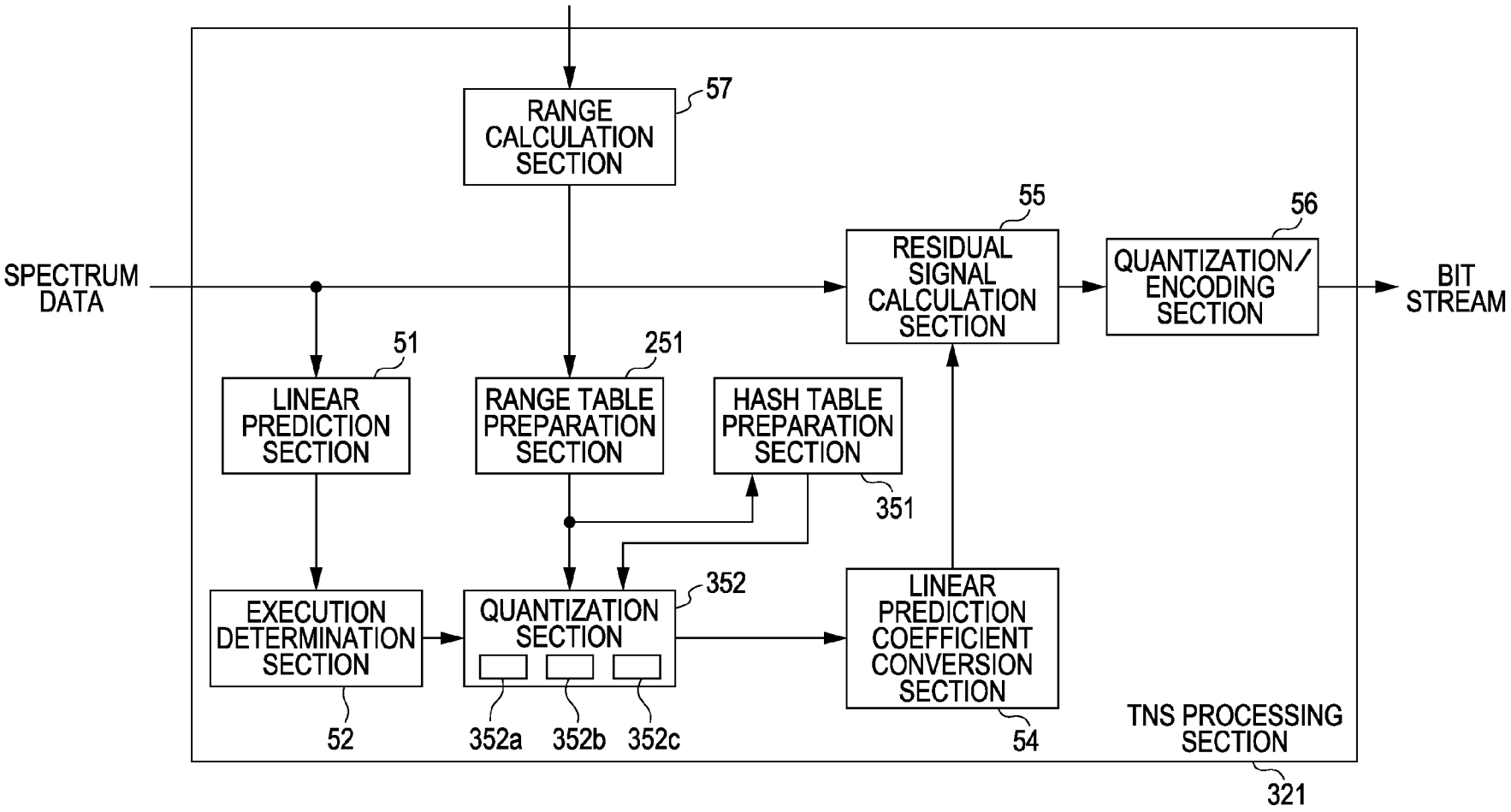
FIG. 11 is a block diagram showing still another exemplary configuration of the TNS processing section.

FIG. 11 shows an exemplary configuration of the TNS processing section which decides the quantized value on the basis of a hash table. Components of a TNS processing section 321 of FIG. 11 that are common to those of the TNS processing section 221 of FIG. 6 are given the same names and the same reference numerals, and their descriptions are omitted as appropriate.

The TNS processing section 321 of FIG. 11 is different from the TNS processing section 221 of FIG. 6 in further including a hash table preparation section 351.

In the TNS processing section 321 of FIG. 11, the range table preparation section 251 prepares a range table, and supplies the prepared range table to the hash table preparation section 351 and the quantization section 352.

The hash table preparation section 351 prepares a hash table allowing quick searching of the table values on the basis of the range table from the range table preparation section 251, and supplies the prepared hash table to the quantization section 352.

The term "hash table" refers to a table containing as table values information indicating groups into which the range in which the reflection coefficient as a table value of the range table is contained is to be grouped in correspondence with the value of the reflection coefficient. That is, when a reflection coefficient is input, a group corresponding to the value of the reflection coefficient is decided using a hash table, and a search is made first using an initial search value, which is a table value with which a first search should be made, for that group. It is thus possible to make quicker searching of the table values than making sequential searching of all the table values defined in the range table. Preparation of a hash table will be discussed in detail later.

The quantization section 352 includes an initial search value deciding section 352*a*, a specifying section 352*b*, and a deciding section 352*c*. The initial search value deciding section 352*a* decides an index (initial search value) for the range table with which to start searching of the table values as (the range of) the reflection coefficient using the hash table supplied from the hash table preparation section 351. The specifying section 352*b* specifies the range in which the reflection coefficient supplied from the execution determination section 52 is contained on the basis of the initial search value and the range table supplied from the range table preparation section 251. The deciding section 352*c* decides the quantized value and the inverse quantized value correlated with the range specified by the specifying section 352*b*, and supplies the decided values to the linear prediction coefficient conversion section 54.

According to the above configuration, the TNS processing section 321 decides the quantized value and the inverse quantized value corresponding to the reflection coefficient obtained from the input spectrum data on the basis of the range table and the hash table prepared in advance.

[Hash Table Preparation Process Performed by TNS Processing Section]

Figure 12:
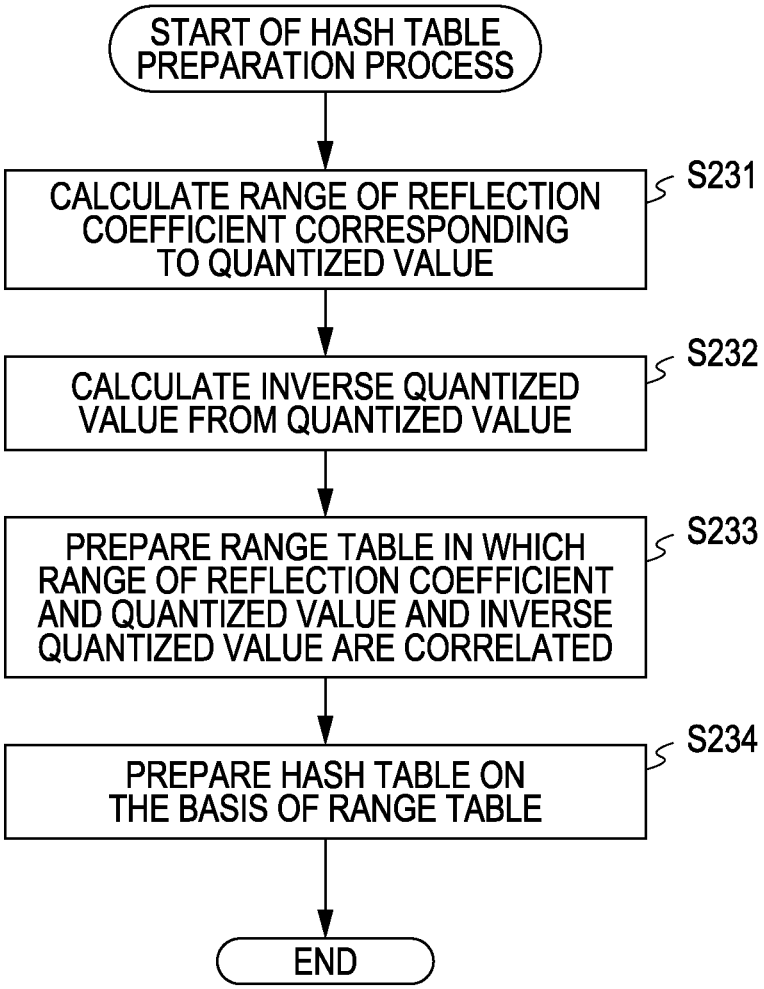
FIG. 12 is a flowchart illustrating a hash table preparation process performed by the TNS processing section of FIG. 11.

A hash table preparation process performed by the TNS processing section 321 of FIG. 11 is next described with reference to the flowchart of FIG. 12. The TNS processing section 321 performs the hash table preparation process before performing the TNS process. The processes in steps S231 to S233 of the flowchart of FIG. 12 are the same as those in steps S131 to S133, respectively, described with reference to the flowchart of FIG. 7, and their descriptions are therefore omitted.

In step S234, the hash table preparation section 351 prepares a hash table on the basis of the range table from the range table preparation section 251, and supplies the prepared hash table to the quantization section 352. More specifically, the hash table preparation section 351 groups into one group such table values (reflection coefficients) in the table arcsin_Q_table[15] indicated by the lines 1 to 6 of the program 281 of FIG. 9 that, after being subjected to a predetermined computation, have an integer part of the same value. The hash table preparation section 351 then prepares a hash table that defines as the initial search value such an index in that group that indicates the range of the reflection coefficient with the smallest value.

As a result of the above process, it is possible to prepare a hash table allowing quick searching of the table values in the range table before the TNS process is performed.

[TNS Process Performed by TNS Processing Section]

Figure 13:
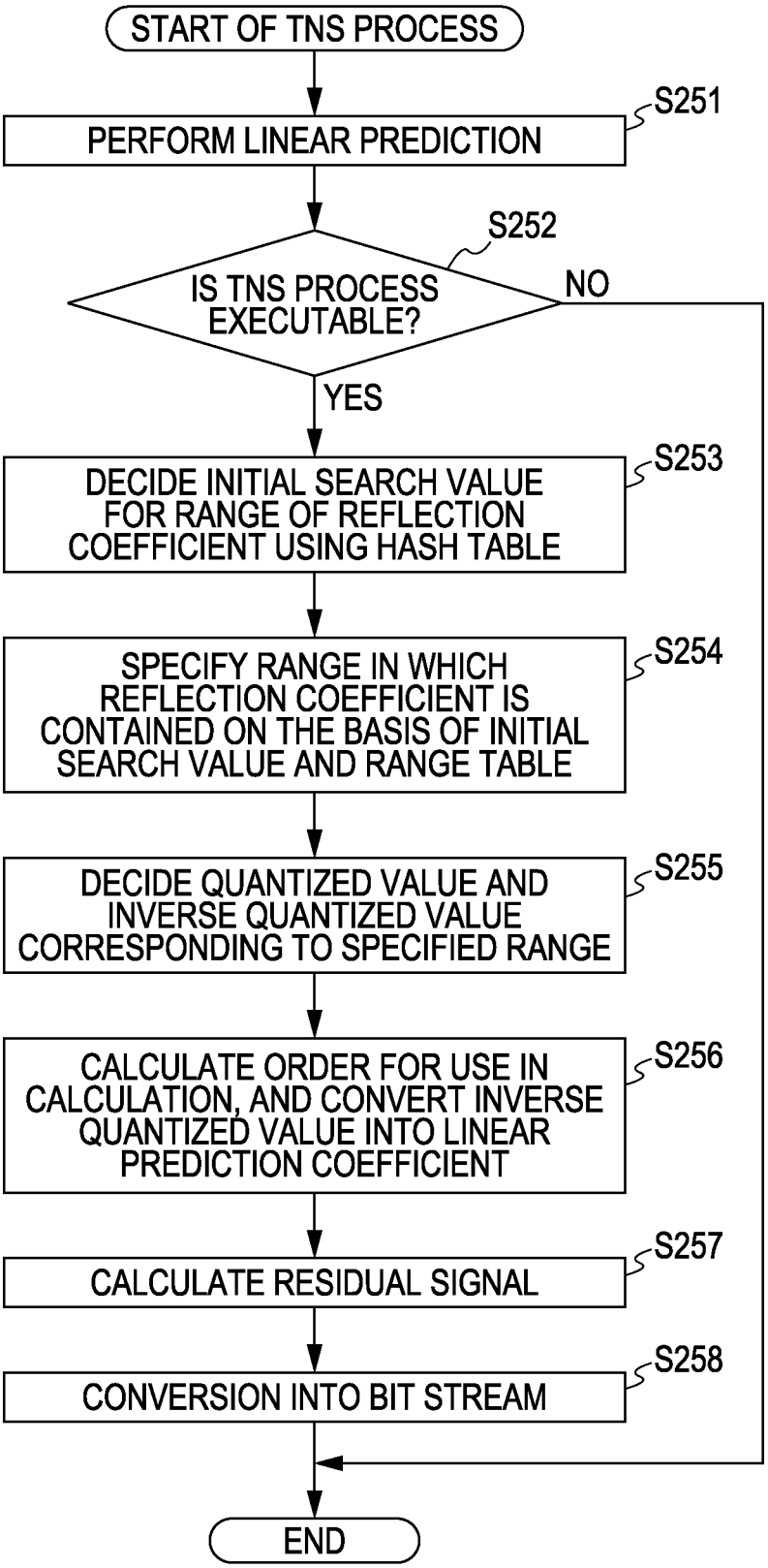
FIG. 13 is a flowchart illustrating a TNS process performed by the TNS processing section of FIG. 11.

A TNS process performed by the TNS processing section 321 of FIG. 11 is next described with reference to the flowchart of FIG. 13. The processes in steps S251, S252, S256 to S258 of the flowchart of FIG. 13 are the same as those in steps S51, S52, S55 to S57, respectively, described with reference to the flowchart of FIG. 4, and their descriptions are therefore omitted.

In step S253, the initial search value deciding section 352*a* of the quantization section 352 decides the initial search value for the table values of the range table as (the range of) the reflection coefficient using the hash table supplied from the hash table preparation section 351. More specifically, the initial search value deciding section 352*a* decides a group of table values in the range table that correspond to the reflection coefficient from the execution determination section 52 using the hash table, and decides the reflection coefficient in the group that has the smallest value as the initial search value.

In step S254, the specifying section 352*b* of the quantization section 352 specifies the range in which the reflection coefficient supplied from the execution determination section 52 is contained on the basis of the initial search value and the range table supplied from the range table preparation section 251.

In step S255, the deciding section 352*c* of the quantization section 352 decides the quantized value and the inverse quantized value correlated with the range specified by the specifying section 352*b*, and supplies the decided values to the linear prediction coefficient conversion section 54.

In this way, it is possible to make quick searching of the table values (the range of the reflection coefficient) using a hash table.

FIG. 14 shows an exemplary program, written in the C language, for the processes performed in steps S253 to S255 of the flowchart of FIG. 13.

In a program 381 of FIG. 14, each table value of a hash table hash_table[8] in the lines 1 to 4 indicates the position (index) of a table value with the smallest value in a group of such table values in the table arcsin_Q_table[15] indicated in the program 281 of FIG. 9 that, after being subjected to a predetermined computation, have an integer part of the same value. Here, the "predetermined computation" is equivalent to the computation specified in the line 5 of the program 381. In this example, the boundary of the range for index[i]=−7 is defined as r[i]<−0.982971. Thus, in order to prepare a hash table with 8 elements, a computation r[i]+1.0F is performed for conversion into a positive value. As a result of the conversion, the boundary of the range for index[i]=6 is defined as 0.9781476F+1.0F=1.9781476F, which is a value less than 2. A value of 4.0F is further multiplied to prepare a hash table with 8 elements.

That is, the integer part T (line 5) of a value obtained by subjecting the reflection coefficient r[i] supplied from the execution determination section 52 to the predetermined computation and the hash table hash_table[T] are used to decide the position k (line 6) of the initial search value in the range table (process in step S253).

When the position k of the initial search value is decided, k is incremented by 1 in the line 7 to specify "arcsin_Q_table [k]" in the line 8, allowing quick searching of the table values in the range table (processes in steps S254, S255).

For example, in the case where the reflection coefficient r[i] is 0.20F, the line 5 of the program 381 derives T=4. The line 6 derives k=7 on the basis of T=4 and the hash table hash_table[T] in the lines 1 to 4. It is then determined in the line 8 whether or not the reflection coefficient r[i] is less than arcsin_Q_table[7]=0.1045285F. Since the reflection coefficient r[i] satisfies r[i]=0.20F, the process returns to the line 7, where k is incremented by 1 (k=8) and it is determined in the line 8 whether or not the reflection coefficient r[i] is less than arcsin_Q_table[8]=0.1045285F. Because the reflection coefficient r[i]=0.20F is less than 0.1045285F, the lines 9, 10 derive the quantized value index[i]=0 and the inverse quantized value rq[i]=0.2079117F. That is, it is possible to obtain the quantized value and the inverse quantized value through 2 searches.

In the program 381, the number of searches is largest at 4 with k=11, namely k=11 to k=14, allowing the quantized value to be decided through at most 4 searches.

According to the program 181 of FIG. 5 and the program 281 of FIG. 9, and in the case where the reflection coefficient r[i] is 0.20F, searches are made sequentially from smaller table values, and the quantized value and the inverse quantized value are obtained through 9 searches.

As a result of the above process, it is possible to decide the quantized value corresponding to the input spectrum data on the basis of the range of the reflection coefficient corresponding to the quantized value obtained in advance. It is thus possible to decide the quantized value without computation using an arcsin function which is a nonlinear function as indicated by the formula (1) but through searches using a hash table, enabling the TNS process to be performed more efficiently and more quickly.

4. Execution Results

Execution Results with TNS Process according to the Embodiments Applied

Figures 15, 16:
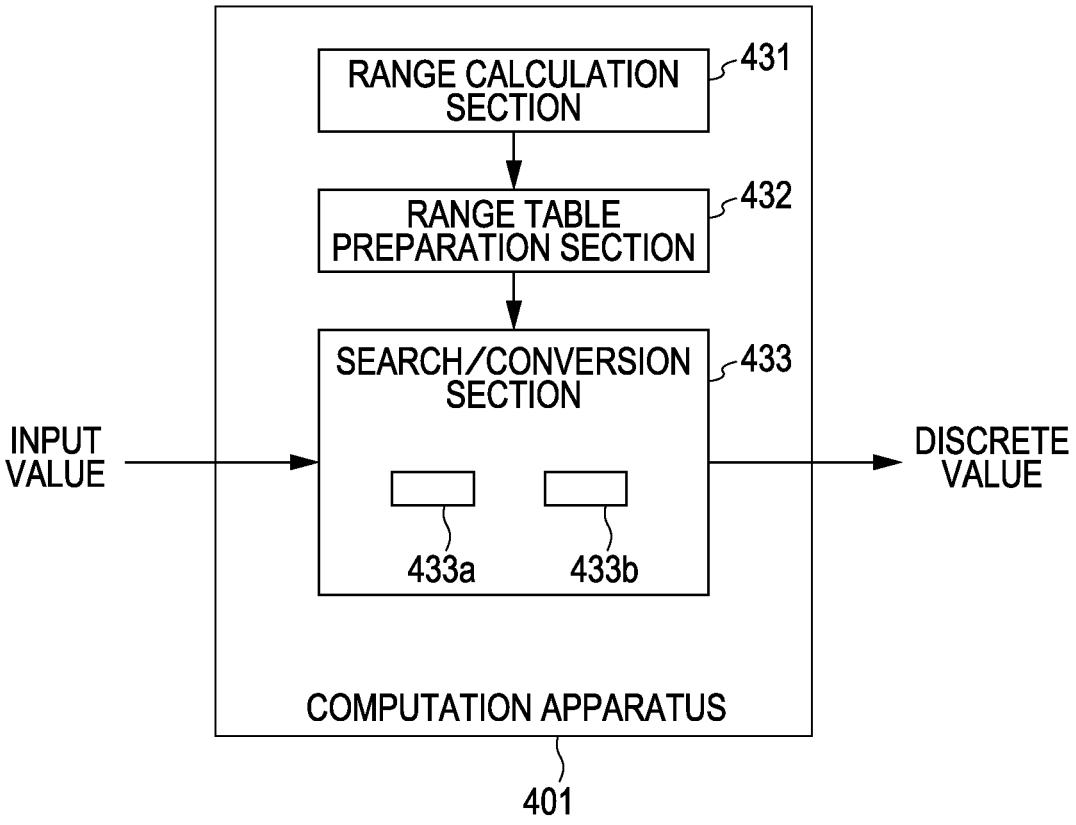
FIG. 15 is a table illustrating the number of cycles performed when each TNS process is applied.
FIG. 16 is a block diagram showing an exemplary configuration of a computation apparatus according to an embodiment of the present invention.

The number of cycles performed when the TNS processes discussed above are applied is now described with reference to FIG. 15. FIG. 15 shows the number of cycles performed when the TNS processes discussed above are executed by an R4000, a RISC (Reduced Instruction Set Computer) CPU manufactured by MIPS.

On the assumption that the number of cycles 18657 performed when the TNS process in the related art including computation using a trigonometric function (an arcsin function which is a nonlinear function as indicated by the formula (1)) stands for 1, the number of cycles 4537 performed when the TNS process using conditional statements (searches using conditions) (FIG. 4) is executed stands for 0.24, exhibiting a 76% improvement in efficiency. The number of cycles 1980 performed when binary searching is used in searches using conditions stands for 0.11, exhibiting a 89% improvement in efficiency.

The number of cycles 7450 performed when the TNS process using a range table (FIG. 8) is executed stands for 0.40, exhibiting a 60% improvement in efficiency. The number of cycles 3854 performed when the TNS process using a hash table (FIG. 15) is executed stands for 0.21, exhibiting a 79% improvement in efficiency.

As described above, it is possible to improve the efficiency with the TNS processes according to the present invention compared to the technique in the related art.

5. Fourth Embodiment

Nonlinear Function and Discrete Value

Although an arcsin function is performed as an example of a nonlinear function in the above description, the present invention is also applicable to a case where a discrete value Y is obtained for a predetermined nonlinear function func(X) of an input value X as indicated in the following formula (7):

[Formula 7]

$$Y=(\text{int})(\text{func}(X)) \tag{7}$$

Meanwhile, although the discrete value is an integer in the example discussed above, it is only necessary that the discrete value Y should be unique to the input value X as indicated by the following formula (8), and the present invention is also applicable to a case where the discrete value Y is a floating-point number.

[Formula 8]

$$Y=(\text{int})(\text{func}(X))+0.45 \tag{8}$$

Further, while it is necessary that the discrete value Y should be unique to the input value X as discussed above, a plurality of ranges of the input value X that give a particular discrete value Y may be provided.

While it is necessary that the discrete value Y should have a finite range in the present invention, it is also possible to apply the embodiment in a range in which the frequency of a computation process for converting the input value X into the discrete value Y is high, and to perform computation as indicated by the formula (7), for example, in the other range.

Although the range of the input value X that gives the discrete value Y is calculated in advance in the above description, it is possible to appropriately recalculate the range of the input value X in the case where the range of the input value X that gives the discrete value Y varies during the conversion of the input value X into the discrete value Y, for example.

[Exemplary Configuration of Computation Apparatus]

A computation apparatus that subjects an input value X to computation using a predetermined nonlinear function func (X) to output a discrete value X is now described with reference to the block diagram of FIG. 16.

A computation apparatus 401 of FIG. 16 includes a range calculation section 431, a range table preparation section 432, and a search/conversion section 433.

The range calculation section 431 calculates the range of the input value that may give the discrete value as an output value, correlates the range of the input value and the discrete value, and supplies to the correlation results to the range table preparation section 432.

The range table preparation section 432 prepares a range table in which the range of the input value and the discrete value from the range calculation section 431 are correlated, and supplies the prepared range table to the search/conversion section 433.

The search/conversion section 433 includes a specifying section 433*a* and a deciding section 433*b*. The specifying section 433*a* specifies the range in which the input value that has been input is contained on the basis of the range of the input value and the discrete value in the range table supplied from the range table preparation section 432. The deciding section 433*b* decides the discrete value correlated with the range specified by the specifying section 433*a*, and outputs the decided value to an external device.

[Range Table Preparation Process Performed by Computation Apparatus]

Figure 17:
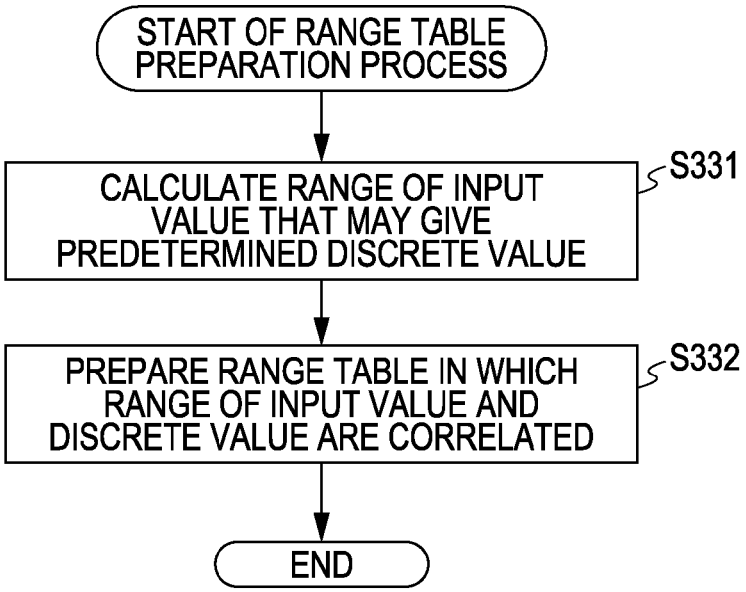
FIG. 17 is a flowchart illustrating a range table preparation process performed by the computation apparatus of FIG. 16.

A range table preparation process performed by the computation apparatus 401 of FIG. 16 is next described with reference to the flowchart of FIG. 17. The computation apparatus 401 performs the range table preparation process before performing a discrete value output process.

In step S331, the range calculation section 431 calculates the range of the input value that may give a predetermined discrete value, correlates the range of the input value and the discrete value, and supplies the correlation results to the range table preparation section 432.

In step S332, the range table preparation section 432 prepares a range table in which the range of the input value and the discrete value from the range calculation section 431 are correlated, and supplies the prepared range table to the search/conversion section 433.

As a result of the above process, it is possible to prepare a range table in which the range of the input value and the discrete value are correlated before the discrete value output process is performed.

[Discrete Value Output Process Performed by Computation Apparatus]

Figure 18:
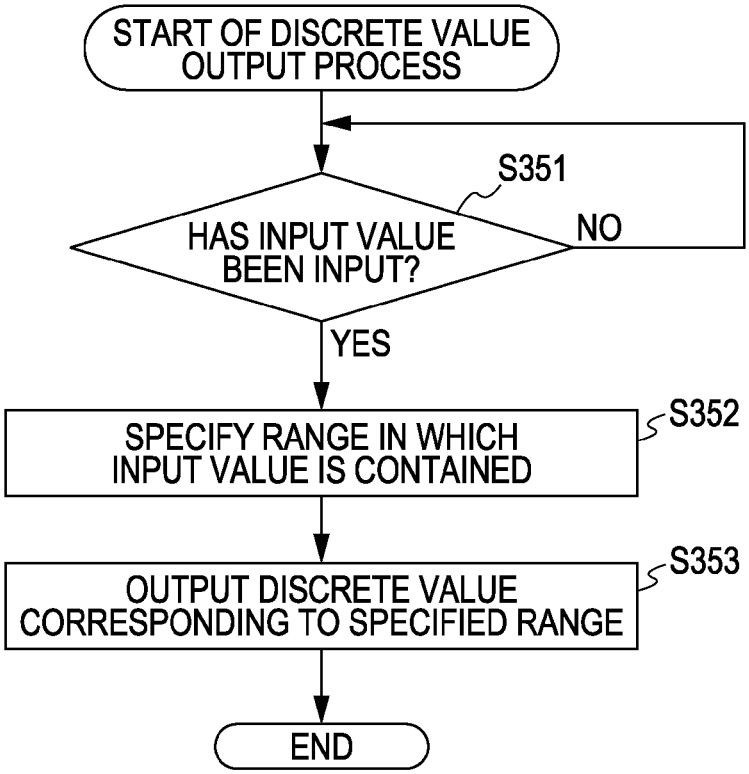
FIG. 18 is a flowchart illustrating a discrete value output process performed by the computation apparatus of FIG. 16.

A range table preparation process performed by the computation apparatus 401 of FIG. 16 is next described with reference to the flowchart of FIG. 18.

In step S351, the search/conversion section 433 determines whether or not an input value has been input. If it is determined that an input value has not been input, the search/conversion section 433 repeats the process in step S351 until an input value is input.

If it is determined in step S351 that an input value has been input, on the other hand, the process proceeds to step S352, where the specifying section 433*a* of the search/conversion section 433 specifies the range in which the input value that has been input is contained on the basis of the range of the input value and the discrete value in the range table supplied from the range table preparation section 432.

In step S353, the deciding section 433*b* of the search/conversion section 433 decides the discrete value correlated with the range specified by the specifying section 433*a*. The search/conversion section 433 outputs the decided discrete value to an external device.

As a result of the above process, it is possible to decide the discrete value corresponding to the input value that has been input on the basis of the range of the input value corresponding to the discrete value obtained in advance. It is thus possible to decide the discrete value without computation using func(X) which is a nonlinear function, for example, but through searches using a range table, enabling the computation process to be performed more efficiently.

Although the computation apparatus 401 of FIG. 16 has one range table, for one input value X, in which the range in which the input value is contained and the discrete value Y are correlated, the computation apparatus 401 may also have a plurality of range tables, for respective types of the input values, in which respective ranges and discrete values of the input values are correlated. That is, the computation apparatus 401 may read a corresponding one of the range tables in correspondence with information, address, etc., indicating the type of the input value, and may output a discrete value corresponding to the range of the input value using the read range table.

Thus, even in the case where different discrete values are to be output for a plurality of types of input values, it is possible for a single computation apparatus to output a plurality of types of discrete values by reading a range table matching the type of the input value.

The sequence of processes discussed above may be executed by means of hardware or by means of software. In the case where the sequence of processes is executed by means of software, a program constituting the software is installed from a program storage medium onto a computer incorporating dedicated hardware, or onto a general-purpose personal computer, for example, which is capable of executing various functions when various programs are installed.

Figure 19:
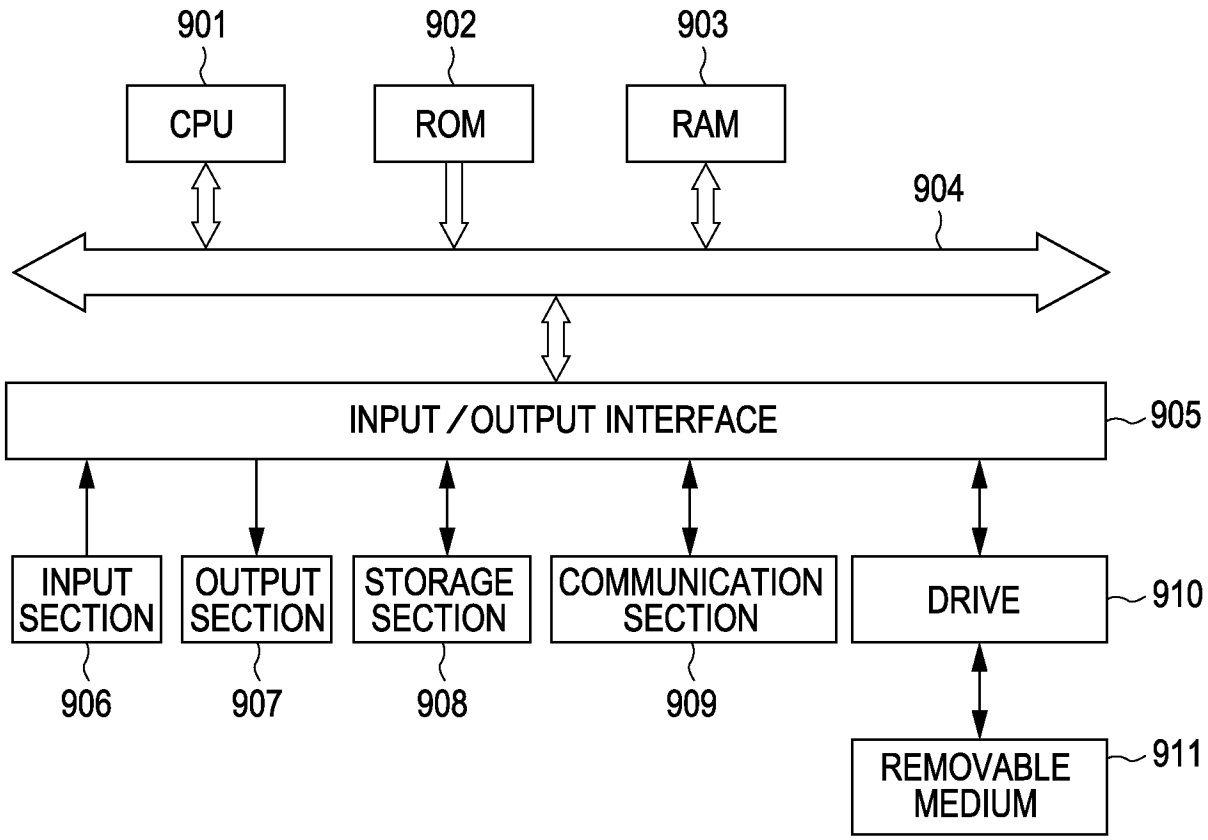
FIG. 19 is a block diagram showing an exemplary configuration of a personal computer.

FIG. 19 is a block diagram showing an exemplary configuration of the hardware of a computer for executing the sequence of processes discussed above through a program.

In the computer, a CPU (Central Processing Unit) 901, a ROM (Read Only Memory) 902, and a RAM (Random Access Memory) 903 are connected to each other through a bus 904.

An input/output interface 905 is further connected to the bus 904. To the input/output interface 905, an input section 906 such as a keyboard, a mouse, and a microphone, an output section 907 such as a display and a speaker, a storage section 908 such as a hard disk drive and a nonvolatile memory, a communication section 909 such as a network interface, and a drive 910 for driving a removable medium 911 such as a magnetic disk, an optical disk, a magneto-optical disk, and a semiconductor memory are connected.

In the computer configured as described above, the CPU 901 loads a program stored in the storage section 908, for example, into the RAM 903 via the input/output interface 905 and the bus 904, and executes the program to perform the sequence of processed discussed above.

The program executed by the computer (CPU 901) is provided as it is recorded in the removable medium 911 as a packaged medium such as a magnetic disk (including a flexible disk), an optical disk (such as a CD-ROM (Compact Disc-Read Only Memory) and a DVD (Digital Versatile Disc)), a magneto-optical disk, and a semiconductor, or via a wired or wireless transfer medium such as a local area network, the Internet, and digital satellite broadcasting, for example.

The program may then be installed onto the storage section 908 via the input/output interface 905 by mounting the removable medium 911 into the drive 910. Alternatively, the program may be received by the communication section 909 and installed onto the storage section 908 via a wired or wireless transfer medium. Still alternatively, the program may be installed in advance in the ROM 902 or the storage section 908.

The program executed by the computer may be configured such that its processes are performed chronologically in accordance with the order described herein, or such that the processes are performed in parallel or at an appropriate timing when a call is made, for example.

The present application contains subject matter related to that disclosed in Japanese Priority Patent Application JP 2008-228163 filed in the Japan Patent Office on Sep. 5, 2008, the entire content of which is hereby incorporated by reference.

The present invention is not limited to the embodiments described above, and may be modified in various ways without departing from the scope and spirit of the present invention.

What is claimed is:

1. A signal processing apparatus configured to encode audio data signals for data communications comprising:

a processor;

an input coupled to the processor configured to receive an audio signal to be processed;

range calculation means for determining a range that includes an input value corresponding to the received audio signal and for providing a predetermined discrete value representative of the input value, wherein the predetermined discrete value is obtained by discretizing a computation result of a nonlinear operation;

discrete value output means for outputting the predetermined discrete value to a residual signal calculator;

summation order determining means for determining a summation order to be used by the residual signal calculator based upon an inverse quantized value of the predetermined discrete value; and the residual signal calculator configured to calculate a residual signal based upon spectrum data of the received audio signal, the determined summation order, and at least one linear predicted coefficient that is based at least in part on the predetermined discrete value.

2. The signal processing apparatus according to claim 1, further comprising:

range table preparation means for preparing a range table in which the range of the input value and the predetermined discrete value are correlated, wherein the discrete value output means is configured to determine the predetermined discrete value corresponding to the range in which the input value is contained on the basis of the range table and outputs the predetermined discrete value.

3. The signal processing apparatus according to claim 2, further comprising:

hash table preparation means for preparing a hash table on the basis of the range table, wherein the discrete value output means is configured to specify an initial search value for the range table on the basis of the hash table, and output the predetermined discrete value corresponding to the range in which the input value is contained on the basis of the initial search value and the range table.

4. The signal processing apparatus according to claim 1, wherein the discrete value output means is configured to perform a binary search of a search range in which the input value is contained, and output the predetermined discrete value corresponding to the searched range.

5. The signal processing apparatus according to claim 1, wherein the range calculation means is configured to calculate the range of the input value corresponding to the predetermined discrete value prior to providing the predetermined discrete value.

6. A signal processing method for operating a signal processing apparatus that is configured to encode audio data signals for data communications, the method comprising acts of:

receiving, by a signal processing unit, an audio data signal;

determining, by a range calculator, a range that includes an input value representative of the received audio data signal;

identifying, by a quantization section, a predetermined discrete value representative of the input value based upon the determined range, wherein the predetermined discrete value is obtained by discretizing a computation result of a nonlinear operation;

outputting the predetermined discrete value to a residual signal calculator;

determining a summation order to be used by the residual signal calculator based upon an inverse quantized value of the predetermined discrete value; and calculating, by the residual signal calculator, a residual signal based upon spectrum data of the received audio data signal, the determined summation order, and at least one linear predicted coefficient, wherein the at least one linear predicted coefficient is based at least in part on the predetermined discrete value.

7. The signal processing method of claim 6, further comprising preparing a range table in which the range of the input value and the predetermined discrete value are correlated, and wherein identifying the predetermined discrete value comprises selecting the predetermined discrete value from the range table based on the correlation.

8. The signal processing method of claim 7, further comprising preparing a hash table based on the range table, and wherein outputting the predetermined discrete value comprises specifying an initial search value for the range table on the basis of the hash table.

9. The signal processing method of claim 6, wherein outputting the predetermined discrete value comprises:

performing a binary search of a search range in which the input value is contained; and outputting the predetermined discrete value corresponding to the searched range.

10. At least one computer storage device having stored thereon a program for causing a processor of a signal processing apparatus to execute a process comprising acts of:

receiving, by a signal processing unit, an audio data signal;

determining, by a range calculator, a range that includes an input value representative of the received audio data signal;

identifying, by a quantization section, a predetermined discrete value representative of the input value based upon the determined range, wherein the predetermined discrete value is obtained by discretizing a computation result of a nonlinear operation;

outputting the predetermined discrete value to a residual signal calculator;

determining a summation order to be used by the residual signal calculator based upon an inverse quantized value of the predetermined discrete value; and calculating, by the residual signal calculator, a residual signal based upon spectrum data of the received audio data signal, the determined summation order, and at least one linear predicted coefficient, wherein the at least one linear predicted coefficient is based at least in part on the predetermined discrete value.

11. A signal processing apparatus comprising:

a signal processor;

an input coupled to the signal processor and configured to receive an audio signal to be processed;

a range calculator configured to determine a range containing an input value of the received audio signal and to provide a predetermined discrete value representative of the input value, wherein the predetermined discrete value is obtained by discretizing a computation result of a nonlinear operation;

a discrete value output section configured to output the predetermined discrete value to a residual signal calculator;

a summation order calculator for determining a summation order to be used by the residual signal calculator based upon an inverse quantized value of the predetermined discrete value; and the residual signal calculator configured to calculate a residual signal based upon spectrum data of the received input audio signal, the determined summation order, and at least one linear predicted coefficient that is based at least in part on the predetermined discrete value.

12. The signal processing apparatus of claim 11, wherein the discrete value output section is further configured to specify an initial search value for searching a range table on the basis of the hash value.

* * * * *